US005334989A

United States Patent [19]

Nagayama et al.

[11] Patent Number: 5,334,989

[45] Date of Patent: Aug. 2, 1994

[54] AUTOMOTIVE WINDOW GLASS ANTENNA

[75] Inventors: Yoji Nagayama; Shingo Tadokoro; Tokio Tsukada, all of Matsusaka, Japan

[73] Assignee: Central Glass Company, Ube, Japan

[21] Appl. No.: 28,920

[22] Filed: Mar. 8, 1993

[30] Foreign Application Priority Data

| | | | |
|---|---|---|---|
| Mar. 6, 1992 | [JP] | Japan | 4-049738 |
| Mar. 19, 1992 | [JP] | Japan | 4-063750 |
| Mar. 19, 1992 | [JP] | Japan | 4-063751 |
| Mar. 31, 1992 | [JP] | Japan | 4-077281 |

[51] Int. Cl.[5] ..... H01Q 1/32

[52] U.S. Cl. ..... 343/713; 343/704

[58] Field of Search ..... 343/713, 704, 711, 712; 219/203; H01Q 1/32, 1/02

[56] References Cited

U.S. PATENT DOCUMENTS

| | | | |
|---|---|---|---|
| 5,049,892 | 9/1991 | Lindenmeier | 343/713 |

FOREIGN PATENT DOCUMENTS

| | | | |
|---|---|---|---|
| 0065263 | 11/1982 | European Pat. Off. . | |
| 0392969 | 10/1990 | European Pat. Off. . | |
| 0418047 | 3/1991 | European Pat. Off. . | |
| 62-37475 | 2/1987 | Japan . | |
| 63-43403 | 2/1988 | Japan . | |
| 1-106502 | 4/1989 | Japan | H01Q 1/32 |
| 2-218202 | 8/1990 | Japan | H01Q 1/32 |
| 3-128503 | 5/1991 | Japan | H01Q 1/32 |
| 3-184401 | 8/1991 | Japan | H01Q 1/32 |
| 4-10801 | 1/1992 | Japan | H01Q 1/32 |
| 4-35506 | 2/1992 | Japan | H01Q 1/32 |

*Primary Examiner*—Donald Hajec
*Assistant Examiner*—Hoanganh Le
*Attorney, Agent, or Firm*—Keck, Mahin & Cate

[57] ABSTRACT

A known first antenna is arranged in a space of a rear window glass above a defogging heater element and constituted by horizontal and vertical conductive strips. In accordance with the present invention, a second antenna is provided which consists of a feed point and a pair of first and second elements connected to the feed point and arranged in a space of the window glass around the heater element. The first element has a vertical conductive strip arranged in an area of the space between the heater element and a lateral edge of the window glass. The first element further has in an area of the space above the first antenna or in a space defined between the upper and lower ends of the first antenna, at least one horizontal conductive strip or a T-shaped or inverted T-shaped conductive strip assembly having a longer horizontal strip portion and a shorter vertical strip portion, or at least two horizontal conductive strips connected at opposite ends by vertical conductive strips to constitute a rectangular loop, or at least two horizontal conductive strips connected at one ends by a vertical conductive strip to constitute a T-shape. The second element is arranged in an area of the space under the heater element and consists of a horizontal conductive strip and a vertical conductive strip.

8 Claims, 7 Drawing Sheets

AUTOMOTIVE WINDOW GLASS ANTENNA

BACKGROUND OF THE INVENTION

1. Field of the Invention

The present invention relates to a glass antenna installed in or on a window glass of an automobile for receiving a radio frequency signal from a portable radio transmitter for controlling the operation of an automotive equipment such as a keyless entry system for automatically unlocking a vehicle door, a similar control system for a luggage compartment lid, a control system for controlling turning on and off of a passenger compartment lamp, etc.

2. Disclosure Information

A keyless entry system for automatically unlocking a vehicle door by receiving a radio frequency signal of a frequency around 40 MHz, 60 MHz, 250 MHz or 300 MHz emitted from a radio transmitter has lately come to attract considerable attention.

In a keyless entry system disclosed in Japanese Provisional Patent Publication No. 62-37475, a pick-up consisting of a loop coil built in a vehicle pillar is used as an antenna. A problem of such a prior art antenna is that it is largely influenced by noise. Another problem is that the antenna is embedded in a vehicle body so that its tuning cannot be attained with ease.

A glass antenna consisting of conductive strips formed on a lower marginal portion of a side window glass by screen printing has been proposed for use in such a keyless entry system as disclosed in Japanese Provisional Publication No. 63-43403. A problem of this glass antenna is that opening and closing of the window causes variations of its gain so that during opening of the window the gains in some directions become so small as to cause malfunction of the keyless entry system.

It has further been proposed to install an antenna for a keyless entry system in or on a rear window glass. However, the most part of the rear window glass is used for installation of the heating element for a defogger, and in many cases an upper marginal part above the heater element or the like part is used for installation of an antenna for receiving TV broadcast waves. For this reason, an antenna for a keyless entry system is subjected to severe arrangement restrictions and has been incapable of attaining a sufficiently large gain when simply installed in or on a remaining marginal part of the rear window glass.

SUMMARY OF THE INVENTION

According to an aspect of the present invention, there is provided an antenna system attached to a vehicle rear window glass for receiving radio waves. The window glass is provided with a defogging heater element so as to leave a space around the heater element. The antenna system comprises a first antenna arranged in an area of the space above the defogging heater element and having a horizontal conductive strip and a vertical conductive strip, and a second antenna having a feed point arranged in a widthwise marginal area of the space under the heater element, and a pair of first and second elements connected to the feed point, respectively.

According to another aspect of the present invention, the first element has a vertical conductive strip arranged in an area of the space between the heater element and a lateral edge of the window glass and a horizontal conductive strip arranged in an area of the space above the heater element.

According to a further aspect of the present invention, the first element has a vertical conductive strip arranged in an area of the space between the heater element and a lateral edge of the window glass, a T-shaped or inverted T-shaped conductive strip assembly made up of a longer horizontal strip portion and a shorter vertical strip portion and arranged in an area of the space above the heater element, and a horizontal conductive strip extending between the vertical strip portion of the T-shaped or inverted T-shaped conductive strip assembly and the vertical conductive strip.

According to a further aspect of the present invention, the first element has a vertical conductive strip arranged in an area of the space between the heater element and a lateral edge of the window glass, a looped conductive strip assembly made up of horizontal strip portions and vertical strip portions and arranged in an area of the space above the heater element, a horizontal conductive strip extending between one of the vertical strip portions of the looped conductive strip assembly and the vertical conductive strip.

According to a further aspect of the present invention, the first element having a first vertical conductive strip arranged in an area of the space between the heater element and a lateral edge of the window glass, -shaped conductive strip assembly having at least two horizontal strip portions and at least one vertical strip portion connecting one ends of the horizontal strip portions and arranged in an area of the space above the heater element, a horizontal conductive strip extending between the vertical strip portion of the T-shaped conductive strip assembly and the first vertical conductive strip.

According to a further aspect of the present invention, the second element further comprises a pair of second horizontal conductive strips, a first vertical conductive strip connecting one ends of the second horizontal conductive strips, and a second vertical conductive strip extending upward from a portion of the second horizontal conductive strips, the first mentioned horizontal conductive strip extending between the second horizontal conductive strip and the feed point.

According to a further aspect of the present invention, the second element comprises a plurality of horizontal conductive strips including the aforementioned horizontal conductive strip of the second element, which have the length of $0.02\lambda \cdot f^{\frac{1}{2}}(1 \pm 0.2)$ and the number of which are in the range of two to four, adjacent two of the horizontal conductive strips of the second element being connected at opposite ends by vertical conductive strips so as to constitute a rectangular loop.

According to a further aspect of the present invention, the horizontal conductive strip of the second element is connected to the feed point and extends horizontally away therefrom to have a bent end, the second element further has a horizontal conductive strip connected to the bent end of the first mentioned horizontal conductive strip of the second element and extending horizontally toward the feed point.

According to a further aspect of the present invention, the second element further comprises a T-shaped or inverted T-shaped conductive strip assembly made up of a longer horizontal strip portion and a shorter vertical strip portion, the aforementioned horizontal conductive strip of the second element extending between the vertical strip portion of the T-shaped or inverted T-shaped conductive strip assembly and the feed point.

According to a further aspect of the present invention, the second element further comprises two horizontal conductive strips which are connected at one ends by a vertical conductive strip, the first mentioned conductive strip of the second element extending between the vertical conductive strip of the second element and the feed point.

The second antenna consisting of the above described first and second elements can solve the above noted problems inherent in the prior art system. Particularly, by various combinations of the above described first and second elements, a fall or dip of gain in a particular direction or directions can be eliminated, thus making it possible to attain an improved gain in any direction.

DETAILED DESCRIPTION OF THE PREFERRED EMBODIMENTS

Figure 1:
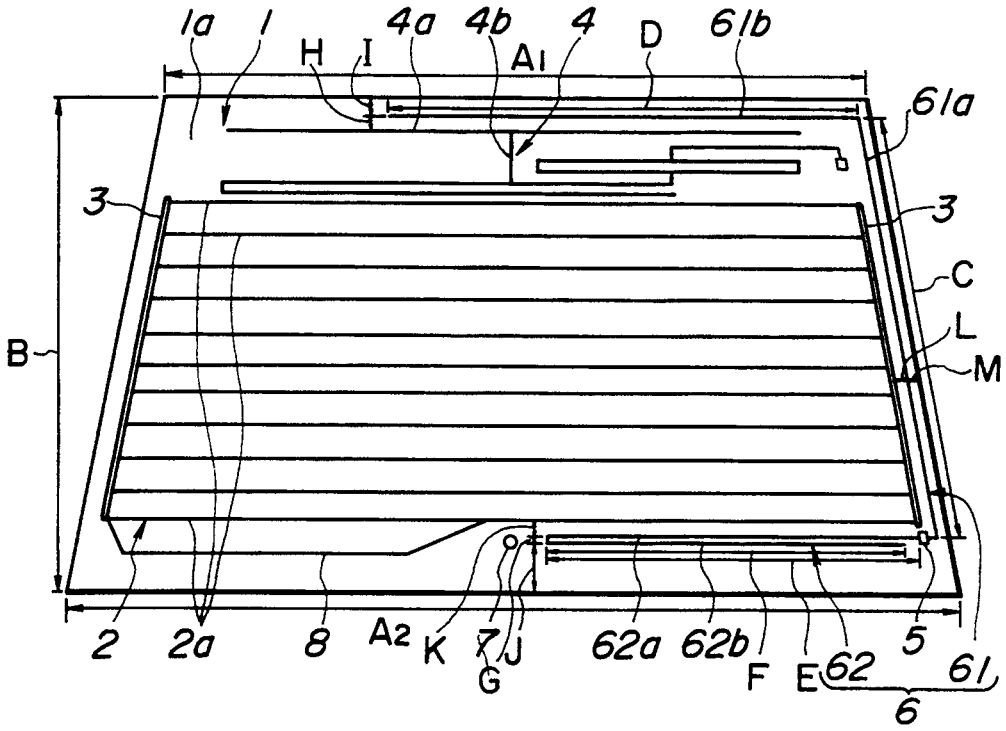
FIGS. 1 to 12 are front views of various embodiments of a glass antenna for an automobile according to the present inventions.

Referring first to FIG. 1, a rear window glass 1 of an automobile has on an inboard surface thereof a defogging electric heater element 2 consisting of a plurality of heating strips 2*a* and bus bars 3, and a conventional first antenna 4 consisting of a horizontal conductive strip 4*a* and a vertical conductive strip 4*b*. The window glass 1 has a space la around the heater element 2. The first antenna 4 is arranged in an area of the space 1*a* above the heater element 2, i.e., between the upper edge of the window glass 1 and the heater element 2.

A second antenna 6 consists of a feed point 5, and a pair of first and second elements 61 and 62. The feed point 5 is arranged in a widthwise marginal area of the space 1*a* under the heater element 2, i.e., in an area of the space 1*a* under one of the bus bars 3.

The first element 61 is made up of a vertical conductive strip 61*a* arranged in an area of the space 1*a* between one of the bus bars 3 and a lateral edge of the window glass 1 and having a lower end connected to the feed point 5, and a horizontal conductive strip 61*b* arranged in an area of the space 1*a* above the heater element 2 or more specifically between the upper edge of the window glass 1 and the first antenna 4 and connected to the upper end of the vertical conductive strip 61*a*.

The second element 62 is made up of a first horizontal conductive strip 62*a* connected to the feed point 5 and extending away therefrom toward the widthwise center of the window glass 1 to have a downwardly bent end, and a second horizontal conductive strip 62*b* connected to the bent end of the first horizontal conductive strip 62*a* and extending therefrom toward the feed point 5. The first and second elements 61 and 62 are formed by screen-printing a conductive paste on the window glass 1 and baking the printed paste.

The window glass 1 is formed with an opening 7 for installation of a wiper (not shown). A heating strip 8 for preventing the freezing of the wiper is provided and formed together with the heater element 2 by screen-printing a conductive paste on the window glass 1 and baking the printed paste.

Figure 13:
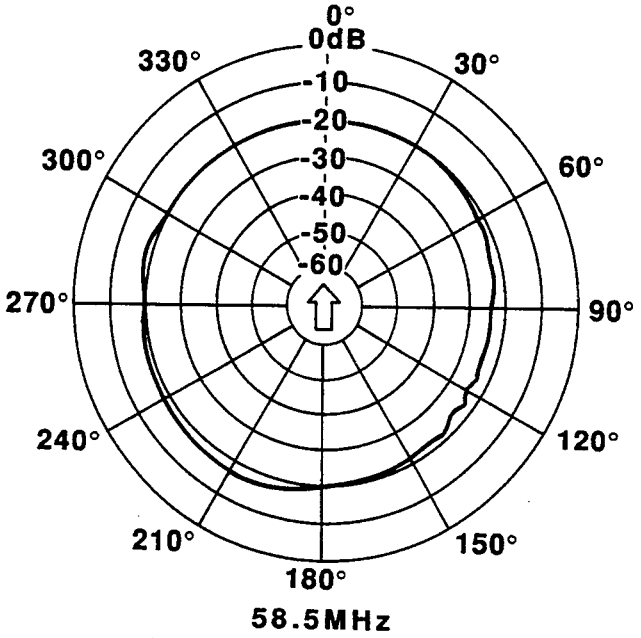
FIGS. 13 and 14 are directivity characteristic distribution diagrams of the glass antennas of FIGS. 1 and 7, respectively.

The various parts of the antenna 6 has such dimensions that $A_1=1000$ mm, $A_2=1400$ mm B=750 mm, C=600 mm, D=640 mm, E=600 mm, F=590 mm, G=10 mm, H=25 mm, I=20 mm, J=80 mm, K=15 mm, L=5 mm, and M=20 mm. With such an automotive glass antenna of FIG. 1, its directivity characteristics were measured by measuring the gains in various directions with respect to FM wave of a frequency of 60 MHz and having a horizontal plane of polarization and expressed by the difference in gain between the antenna of this embodiment and a standard dipole antenna on the assumption that the gain of the dipole antenna is zero (hereinafter the difference is referred to as a dipole ratio), to represent the directivity characteristic. The result of the directivity characteristic is shown in FIG. 13. As seen from FIG. 13, all the gains measured every five degrees (i.e., in the seventy-two directions) are larger than −25 dB (minimum gain is −24.4 dB), and the average of the gains in the seventy-two directions is −20.0 dB. Since the gain necessary for automatic unlocking of an automotive door or for similar automatic control of other automotive equipments is about −25 dB, the antenna of this embodiment can operate them properly by receiving a radio frequency signal from any direction.

Figure 2A:
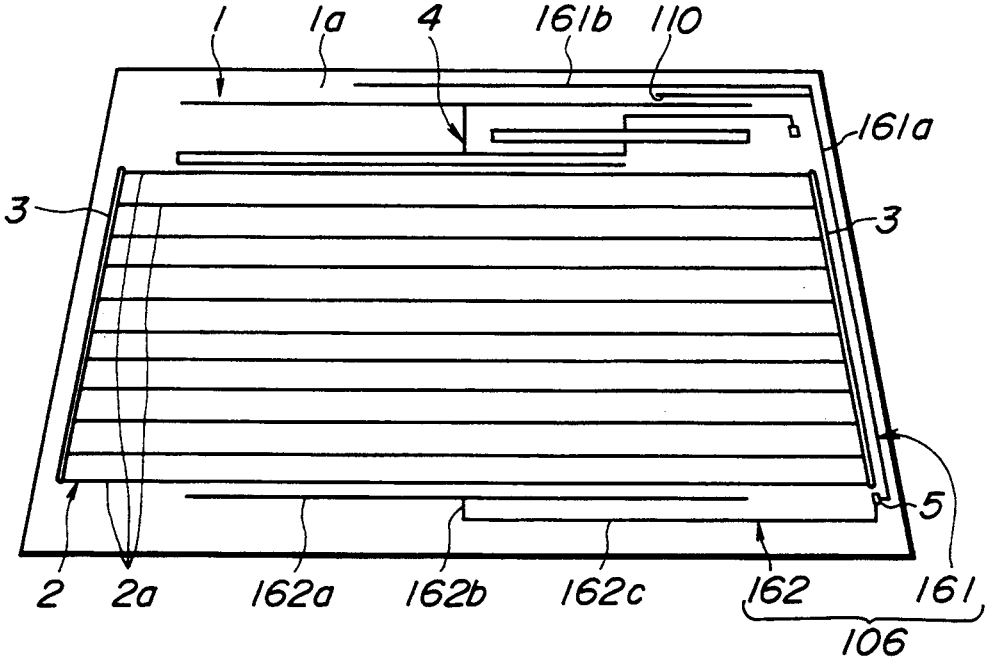

FIG. 2A shows another embodiment which is not adapted for installation of a wiper and which differs from the previous embodiment of FIG. 1 in that the horizontal conductive strip 161*b* of the first element 161 has the horizontal length of 750 mm, the first element 161 further includes an auxiliary element 110 consisting of a horizontal conductive strip having the horizontal length of 250 mm, the auxiliary element 110 being connected at one end to the vertical conductive strip 161*a* and disposed between the horizontal strip 161*b* and the first antenna 4 the second element 162 is made up of a horizontal conductive strip 162*a* having the horizontal length of 800 mm, a vertical conductive strip 162*b* having the vertical length of 40 mm and connected at an upper end to the lengthwise center of the horizontal conductive strip 162*a* to constitute a T-shaped conductive strip assembly, and a generally horizontal conductive strip 162*c* extending between the lower end of the vertical strip 162*b* and the feed point 5. Except for the above, this embodiment is substantially similar to the previous embodiment of FIG. 1.

With such an automotive glass antenna of FIG. 2A, the gains in various directions with respect to FM wave of a frequency of 40 MHz and having a horizontal plane of polarization were measured and expressed by the above mentioned dipole ratio to represent the directivity characteristic. The result of the directivity characteristic was such that the average of the gains in the seventy-two directions was −17.6 dB and the minimum gain was −23.2 dB. This embodiment thus can function properly with respect to a radio wave from any direction and therefore can produce substantially the same effect with the previous embodiment of FIG. 1.

Figure 2B:
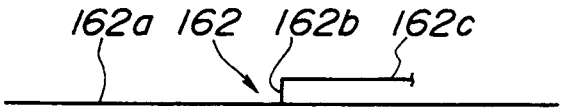

FIG. 2B shows a variant of the second element 162 of FIG. 2A, in which the conductive strips 162*a* and 162*b* are joined to constitute an inverted T-shaped conductive strip assembly. With such a second element 162 of FIG. 2B, a similar effect to the embodiment of FIG. 2A can be attained.

Figure 3:
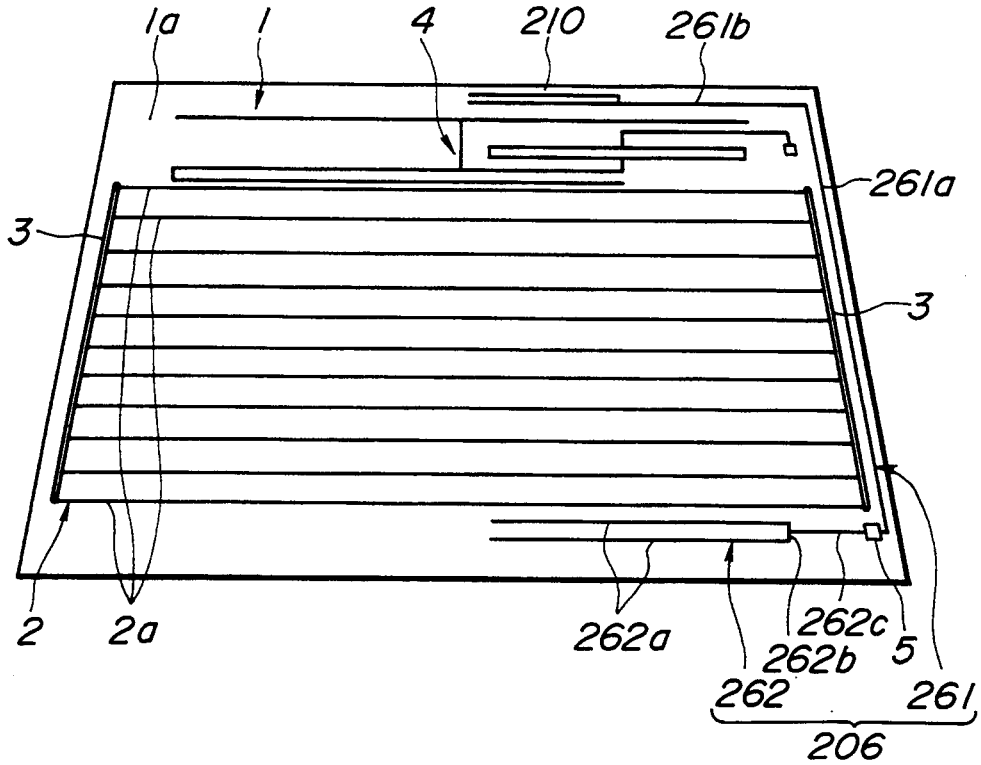

FIG. 3 shows a further embodiment which is not adapted for installation of a wiper and which differs from the previous embodiment of FIG. 1 in that the horizontal conductive strip 261*b* of the first element 261 has the horizontal length of 450 mm, the first element 261 further includes an auxiliary element 210 made up of a generally horizontal conductive strip of the horizontal length of 200 mm, disposed between the horizontal conductive strip 261*b* and the upper marginal end of the rear window glass 1 and connected at a vertically bent end to a longitudinally intermediate portion of the horizontal conductive strip 261*b*, the second element 262 consists of two horizontal conductive strips 262*a* of the horizontal length of 450 mm, a vertical conductive strip 262*b* having the length of 20 mm and connecting the ends of the horizontal conductive strips 262*a* located nearer to the feed point 5, and a horizontal conductive strip 262*c* having the horizontal length of 100 mm and extending between the vertical conductive strip 262*b* and the feed point 5 to interconnect the same. Except for the above, this embodiment is constructed and sized substantially similarly to the previous embodiment of FIG. 1.

With such an automotive glass antenna of FIG. 3, the gains in various directions were measured with respect to FM wave of a frequency of 250 MHz and having a horizontal plane of polarization and expressed by the aforementioned dipole ratio to represent the directivity characteristic. The result of the directivity characteristic was such that the average of the gains in the seventy-two directions was −17.4 dB and the minimum gain was −23.8 dB. Accordingly, this embodiment can function properly with respect to radio wave from any direction and thus can produce substantially the same effect to the embodiment of FIG. 1.

Figure 4A:
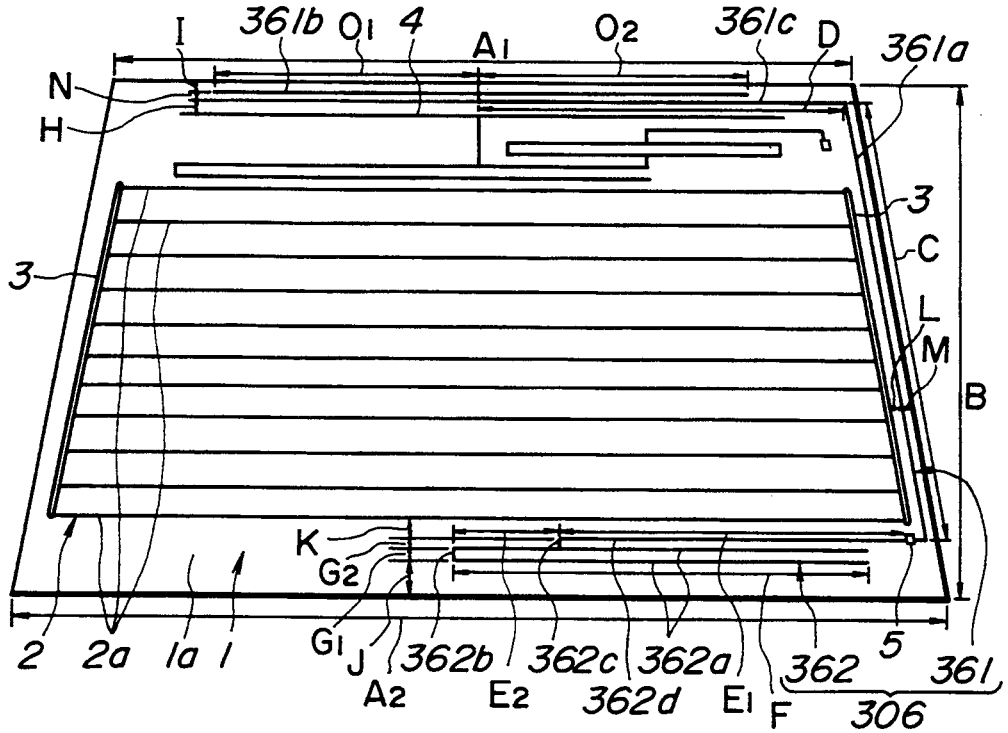

FIG. 4A shows a further embodiment in which the first element 361 of the first antenna 361 is made up of a vertical conductive strip 361*a*, a T-shaped conductive strip assembly 361*b* arranged in an area of the space 1*a* between the upper edge of the window glass 1 and the first antenna 4, and a horizontal conductive strip 361*c* extending between the vertical portion of the T-shaped conductive strip assembly 361*b* and the upper end of the vertical conductive strip 361*a*. The second element 362 is made up of two horizontal conductive strips 362*a* arranged in an area of the space 1*a* under the heater element 2, i.e., between the lower edge of the window glass 1 and the heater element 2, a first vertical conductive strip 362*b* connecting one ends of the horizontal conductive strips 362*a*, a second vertical conductive strip 362*c* extending upward from a portion of the horizontal conductive strips 362*a* and a horizontal conductive strip 362*d* extending between the second vertical strip 362*c* and the feed point 5. The first and second elements 361 and 362 are formed by screen-printing a conductive paste on the window glass 1 and baking the printed paste.

The various parts of the second antenna 6 have such dimensions that $A_1=1000$, $A_2=1400$, $B=750$ mm, $C=600$ mm, $D=480$ mm, $E_1=600$ mm, $E_2=150$ mm, $F=700$ mm, $G_1=10$ mm, $G_2=10$ mm, $H=25$ mm, $I=20$ mm, $J=60$ mm, $K=20$ mm, $L=10$ mm, $M=20$ mm, $N=10$ mm, $O_1=O_2=400$ mm.

With such an automotive glass antenna of FIG. 4A, the gains in various directions with respect to FM wave of a frequency of 40 MHz and having a horizontal plane of polarization were measured and expressed by the above mentioned dipole ratio to represent the directivity characteristic. The result of the directivity characteristic was such that all the gains measured every five degrees (i.e., in the seventy-two directions) were larger than −25 dB (minimum gain was −24.6 dB), and the average of the gains in the seventy-two directions was −17.6 dB. Since the gain necessary for automatic unlocking of an automotive door or for similar automatic control of other automotive equipments is about −25 dB, the antenna of this embodiment can operate them properly by receiving a radio frequency signal from any direction.

Figure 4B:
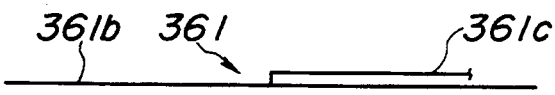
Figure 5:
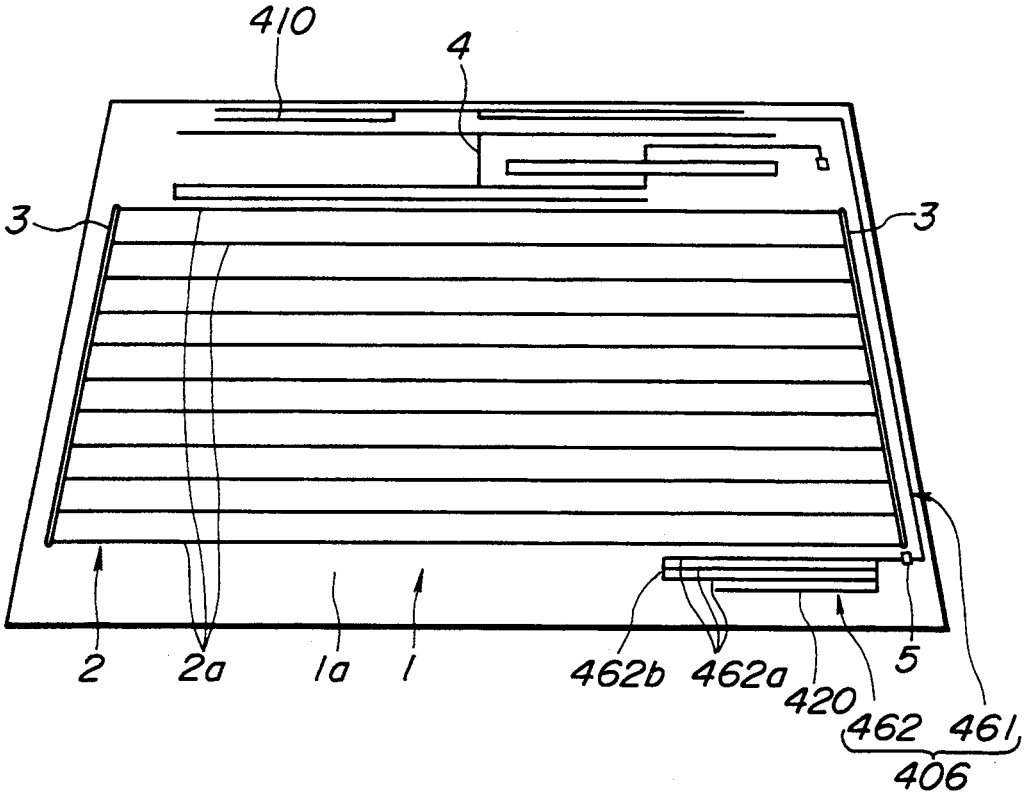

FIG. 4B shows a variant of the first element 361 of FIG. 4A, in which the conductive strip assembly 361*b* is formed into an inverted T-shape. With such a first element 361 of FIG. 4B, a similar effect to the embodiment of FIG. 4A can be attained. FIG. 5 shows a further embodiment which differs from the previous embodiment of FIG. 4A in that the first element 461 further includes an auxiliary element 410 of the horizontal length of 250 mm, the second element 462 is made up of three horizontal conductive strips 462*a* of the horizontal length of 380 mm, which horizontal strips 462*a* are arranged at vertical intervals of 10 mm and connected at opposite ends by vertical conductive strips 462*b* to constitute two rectangular loops which are vertically continuous to each other, and the second element 462 further includes an auxiliary element 420 made up of a generally horizontal conductive strip and connected to one of the vertical conductive strips 462*b*. The auxiliary element 420 of the second element 462 is disposed under the rectangular loops constituted by the horizontal conductive strips 462*a* and the vertical conductive strips 462*b*, whereas the auxiliary element 410 is disposed between the first antenna 4 and the horizontal conductive strip 461*b* of the first element 461. Except for the above, this embodiment is substantially similar to the previous embodiment of FIG. 4A.

With such an automotive glass antenna of FIG. 5, the gains in various directions with respect to FM wave of a frequency of 250 MHz and having a horizontal plane of polarization were measured and expressed by the above mentioned dipole ratio to represent the directivity characteristic. The result of the directivity characteristic was such that all the gains measured every five degrees (i.e., in the seventy-two directions) are larger than −25 dB (minimum gain is −24.0 dB), and the average of the gains in the seventy-two directions is −16.7 dB. This embodiment is superior in directivity characteristic to the previous embodiment of FIG. 4A and thus can function properly with respect to a radio frequency signal from any direction.

Figure 6:
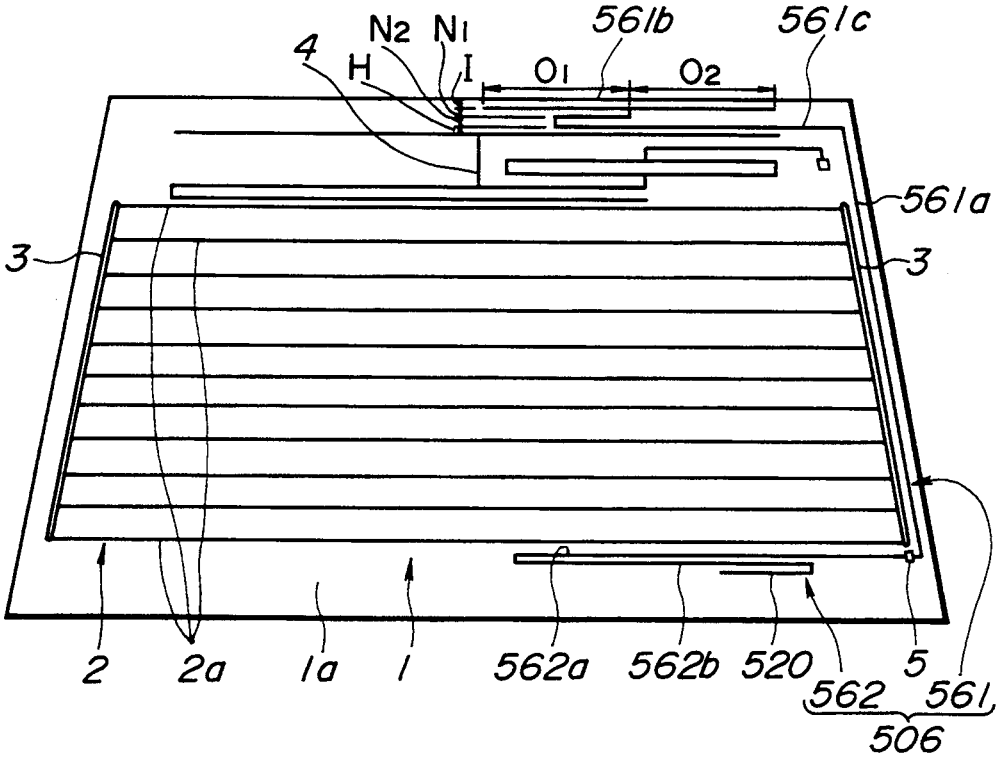

FIG. 6 shows a further embodiment which differs from the previous embodiment of FIG. 4A in that the T-shaped conductive strip assembly 561*b* of the first element 561 is sized such that its horizontal portions divided by the vertical portion have the same horizontal length of 200 mm (i.e., $O_1=O_2=200$ mm), which T-shaped conductive strip assembly 561*b* is arranged on one of the sides divided by the widthwise center of the window glass 1, various parts of the first element 561 have such dimensions that $H=20$ mm, $I=15$ mm, $N_1=10$ mm and $N_2=10$ mm, the second element 562 is made up of a first generally horizontal conductive strip 562*a* of the horizontal length of 600 mm, which horizontal conductive strip 562 is connected to the feed point 5 and extends away therefrom toward the widthwise center of the window glass 1 to have a downwardly bent end, and a second horizontal conductive strip 562*b* of the horizontal length of 450 mm, which second horizontal conductive strip 562*b* is connected to the downwardly bent end of the first horizontal strip 562*a* and extends away therefrom toward the feed point 5, and the second element 562 further includes an auxiliary element 520 made up of a horizontal conductive strip of the horizontal length of 100 mm and connected to the second horizontal conductive strip 562b. Except for the above, this embodiment is substantially similar to the previous embodiment of FIG. 4A.

With such an automotive glass antenna of FIG. 6, the gains in various directions with respect to FM wave of a frequency of 60 MHz and having a horizontal plane of polarization were measured and expressed by the above mentioned dipole ratio to represent the directivity characteristic. The result of the directivity characteristic was such that the average of the gains in the seventy-two directions was −18.7 dB and the minimum gain was −23.8 dB. This embodiment thus can function properly with respect to a radio wave from any direction and therefore can produce substantially the same effect with the previous embodiment of FIG. 4A.

Figure 7:
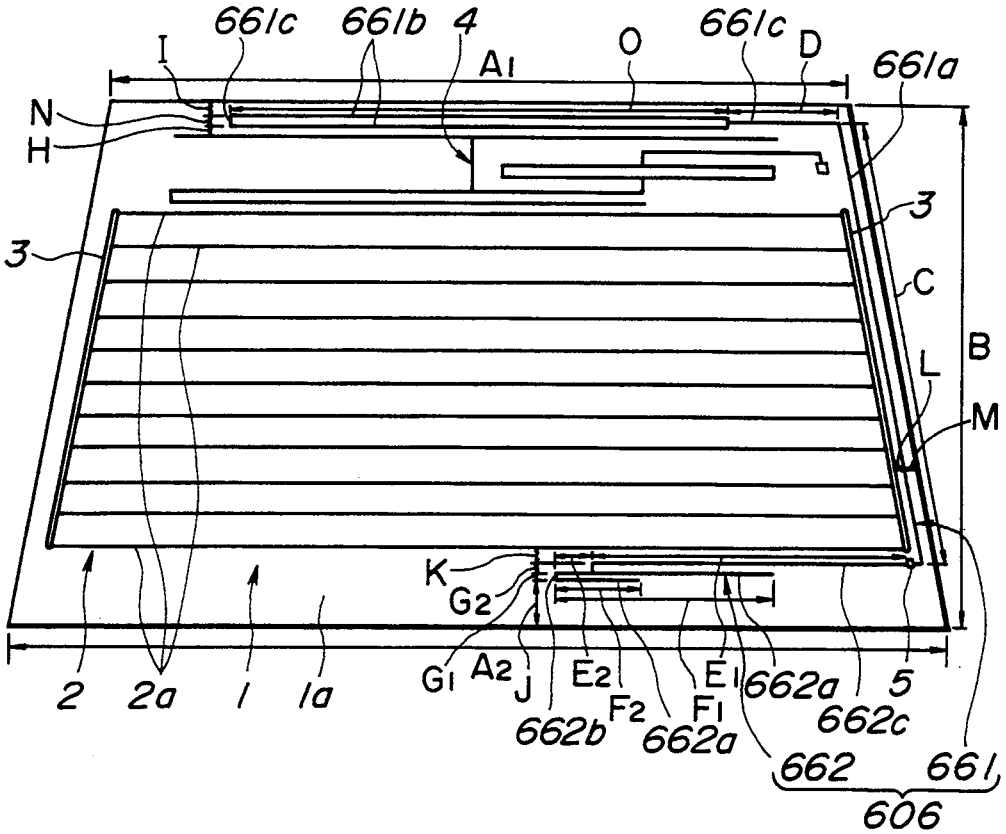

FIG. 7 shows a further embodiment in which the second glass antenna 606 consists of a first element 661 and a second element 662.

The first element 661 is made up of a vertical conductive strip 361a, two horizontal conductive strips 661b arranged in an area of the space 1a between the upper edge of the window glass 1 and the first antenna 4, two vertical conductive strips 661c connecting the opposite ends of the horizontal conductive strips 661b to constitute a rectangular loop, and a horizontal conductive strip 661c extending between one of the vertical conductive strips 661c and the upper end of the vertical conductive strip 661a.

The second element 662 is made up of two horizontal conductive strips 662a, 662b of the different horizontal length and arranged in an area of the space 1a between the lower edge of the window glass 1 and the defogging electric heater element 2, a vertical conductive strip 662b connecting one ends of the horizontal conductive strips 662a, 662b and a generally horizontal conductive strip 662c extending upward from the upper horizontal conductive strip 662b and then horizontally toward the feed point 5 for connection between them. The first and second elements 661 and 662 are formed by screen-printing a conductive paste on the window glass 1 and baking the printed paste.

The various parts of the second antenna 606 have such dimensions that $A_1=1000$ mm, $A_2=1400$ mm, B=750 mm, C=600 mm, D=130 mm, $E_1=560$ mm, $E_2=50$ mm, $F_1=300$ mm, $F_2=150$ mm, $G_1=10$ mm, $G_2=10$ mm, H=20 mm, I =10 mm, J=60 mm, K=20 mm, L=10 mm, M=20 mm, N=15 mm, O=700 mm.

Figure 14:
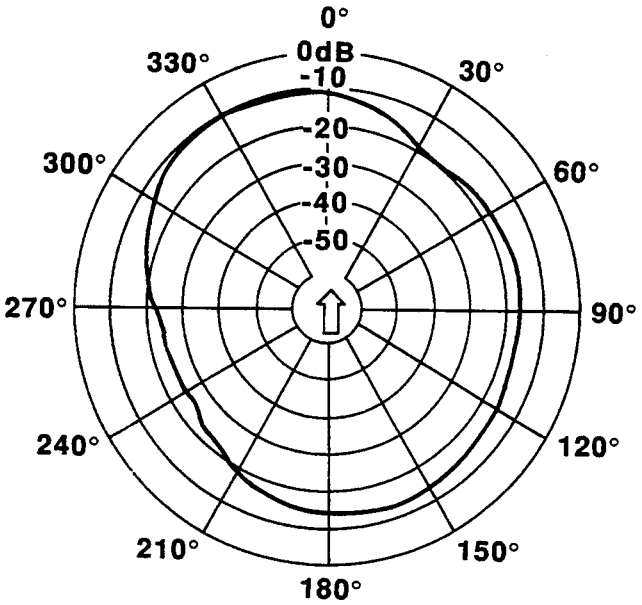

With such an automotive glass antenna of FIG. 7, the gains in various directions with respect to FM wave of a frequency of 60 MHz and having a horizontal plane of polarization were measured and expressed by the above mentioned dipole ratio to represent the directivity characteristic. The result of the directivity characteristic is shown in FIG. 14. As seen from FIG. 14, all the gains measured every five degrees (i.e., in the seventy-two directions) are larger than −25 dB (minimum gain is −24.5 dB), and the average of the gains in the seventy-two directions is −17.3 dB. Since the gain necessary for automatic unlocking of an automotive door or for similar automatic control of other automotive equipments is about −25 dB, the antenna of this embodiment can operate them properly by receiving a radio frequency signal from any direction.

Figure 8:
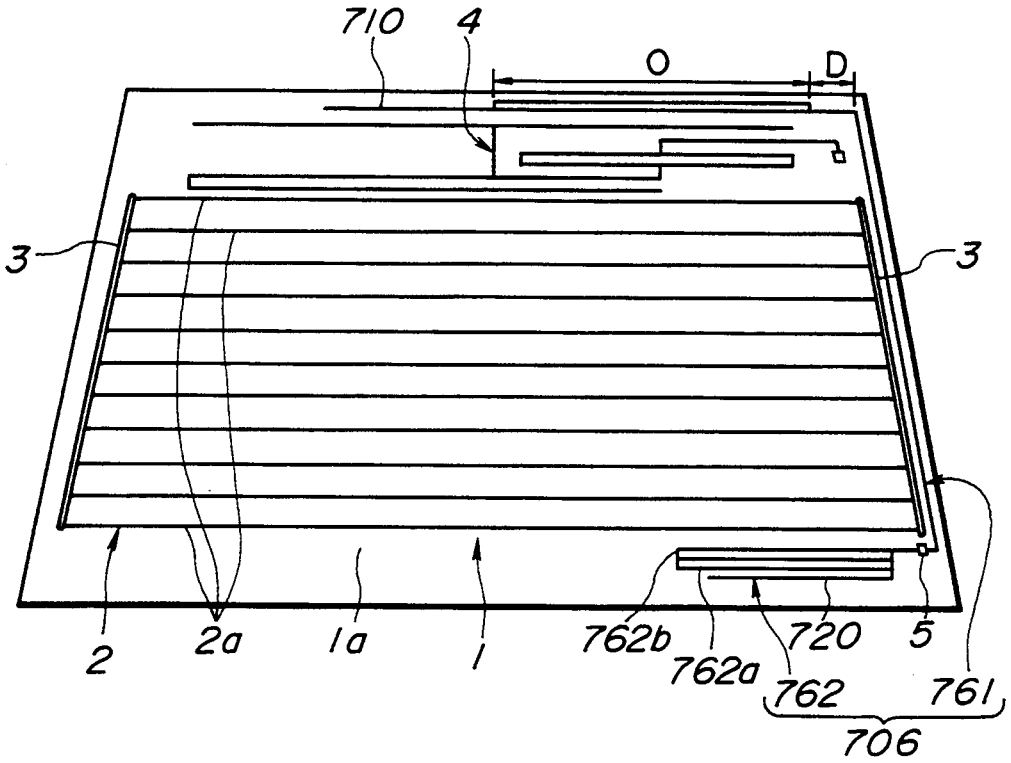

FIG. 8 shows a further embodiment which differs from the previous embodiment of FIG. 7 in that the first element 761 is sized such that O=410 mm and D=60 mm, the first element 761 further includes an auxiliary element 710 made up of a horizontal conductive strip of the horizontal length of 250 mm, the second element 762 is made up of three horizontal conductive strips 762a of the horizontal length of 380 mm and arranged at vertical intervals of 10 mm, and vertical conductive strips 762b connecting the opposite ends of the horizontal conductive strips 762a to constitute two rectangular loops which are vertically continuous to each other, and the second element 762 further includes an auxiliary element 720 made up of a generally horizontal conductive strip connected to one of the vertical conductive strips 762b.

With such an automotive glass antenna of FIG. 8, the gains in various directions with respect to FM wave of a frequency of 250 MHz and having a horizontal plane of polarization were measured and expressed by the above mentioned dipole ratio to represent the directivity characteristic. The result of the directivity characteristic was such that all the gains measured every five degrees (i.e., in the seventy-two directions) are larger than −25 dB (minimum gain is 24.0 dB), and the average of the gains in the seventy-two directions is −16.3 dB. This embodiment is superior in directivity characteristic to the previous embodiment of FIG. 7 and thus can function properly with respect to a radio frequency signal from any direction.

Figure 9:
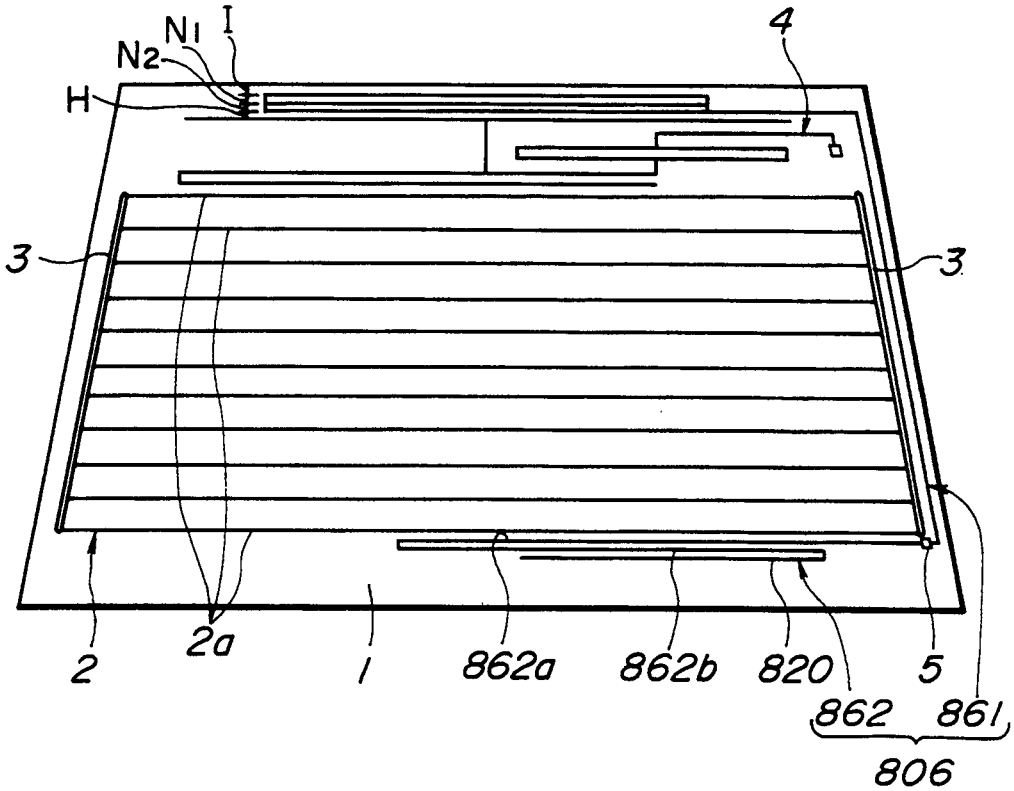

FIG. 9 shows a further embodiment which differs from the previous embodiment of FIG. 7 in that the first element 861 consists of three horizontal conductive strips 861b and two vertical conductive strips 861c which are joined to constitute two rectangular loops, the first element 861 is sized such that H=15 mm, I=20 mm and $N_1=N_2=10$ mm, and the second element 862 consists of a first horizontal conductive strip 862a of the horizontal length of 800 mm, connected to the feed point 5 and extending away therefrom to terminate at a downwardly bent end, and a second horizontal conductive strip 862b of the horizontal length of 700 mm, connected to the bent end of the first horizontal conductive strip 862a and extending away therefrom toward the feed point 5, and the second element 862 further includes an auxiliary element 820 made up of a horizontal conductive strip of the horizontal length of 400 mm and connected to the second horizontal conductive strip 862b.

With such an automotive glass antenna of FIG. 9, the gains in various directions with respect to FM wave of a frequency of 40 MHz and having a horizontal plane of polarization and expressed by the above mentioned dipole ratio to represent the directivity characteristic. The result of the directivity characteristic was such that the average of the gains in the seventy-two directions was 18.4 dB, and the minimum gain is −24.1 dB. This embodiment thus can function properly with respect to a radio wave from any direction and therefore can produce substantially the same effect with the previous embodiment of FIG. 7.

Figure 10:
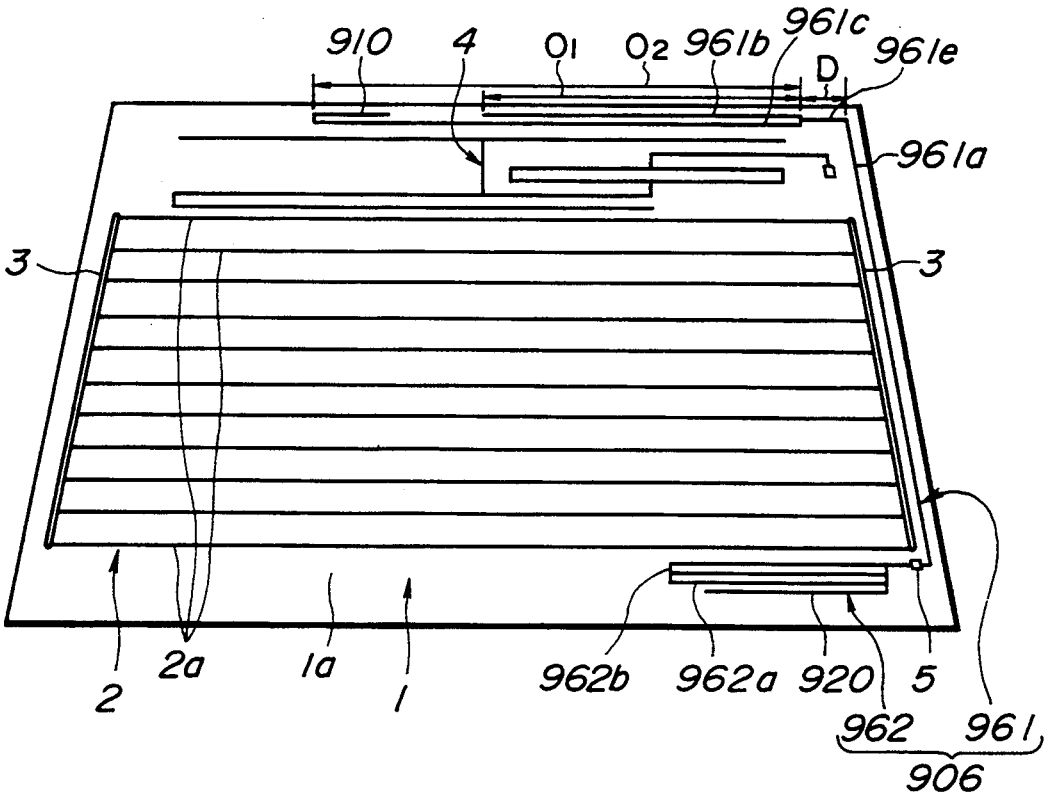

FIG. 10 shows a further embodiment in which the first element 961 for the second antenna 906 consists of a T-shaped portion made up of two horizontal conductive strips 961b, 961c and a vertical conductive strip 961d connecting one ends of the horizontal conductive strips 961b, 961c. The T-shaped portion is disposed in an area of the space 1a above the first antenna 4 and connected via a horizontal conductive strip 961e to the vertical conductive strip 961a. The first element 961 is sized such that $O_1=450$ mm, $O_2=700$ mm and $D=60$ mm. The first element 61 is provided with an auxiliary element 910 of the horizontal length of 100 mm.

The second element 962 for the second antenna 906 consists of three horizontal conductive strips 962*a* of the horizontal length of 380 mm, which horizontal conductive strips 962*a* are arranged at vertical intervals of 10 mm and connected at opposite ends by vertical conductive strips 962*b* to constitute two rectangular loops which are vertically continuous to each other. The second element 962 is provided with an auxiliary element 920.

With such an automotive glass antenna of FIG. 10, the gains in various directions with respect to FM wave of a frequency of 250 MHz and having a horizontal plane of polarization were measured and expressed by the above mentioned dipole ratio to represent the directivity characteristic. The result of the directivity characteristic was such that all the gains measured every five degrees (i.e., in the seventy-two directions) are larger than −25 dB (minimum gain was 24.0 dB), and the average of the gains in the seventy-two directions is −16.3 dB. The antenna of this embodiment is thus superior in directivity characteristic to the previous embodiment of FIG. 1 and thus can function properly with respect to a radio frequency signal from any direction.

Figure 11:
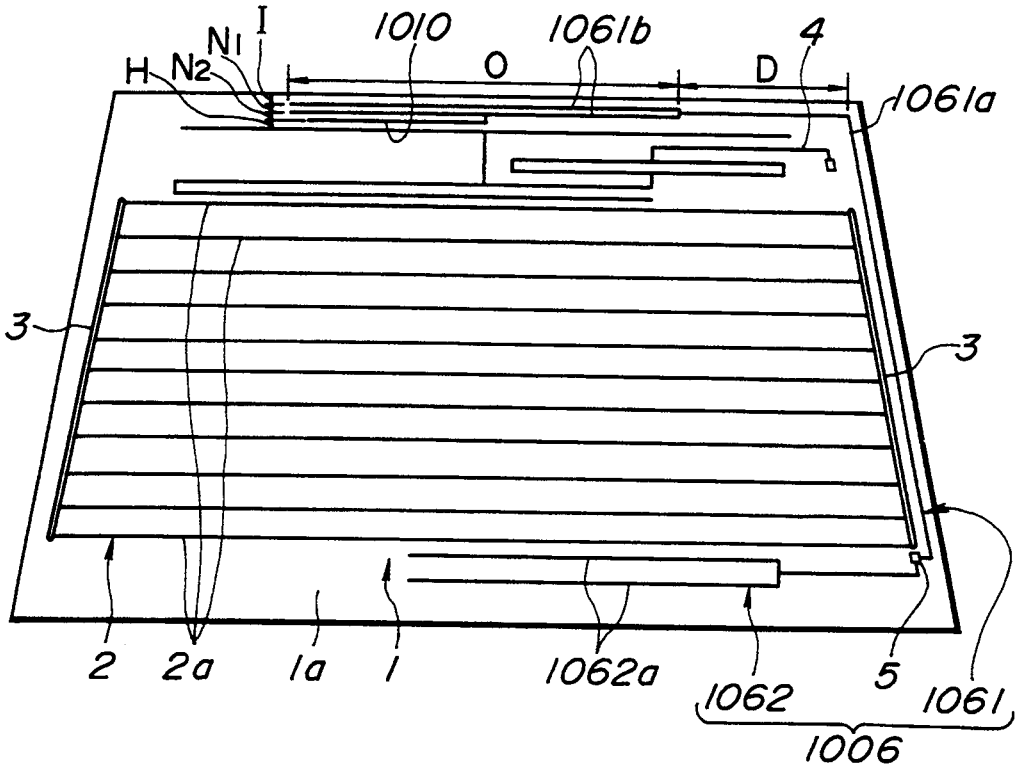

FIG. 11 shows a further embodiment which differs from the previous embodiment of FIG. 10 in that the first element 1061 has two horizontal conductive strips 1061*b* of the same length and is sized such that $O=550$ mm and $D=240$ mm, the first element 1061 is provided with an auxiliary element 1010 of the horizontal length of 260 mm, the second element 1062 consists of two horizontal conductive strips 1062*a* of the length of 500 mm and a vertical conductive strip 1062*b* connecting one ends of the horizontal conductive strips 1062*a*, and extends horizontally from the vertical conductive strip 1062*b* to be connected to the feed point 5. Except for the above, this embodiment is substantially similar to the previous embodiment of FIG. 10.

With such an automotive glass antenna of FIG. 11, the gains in various directions were measured with respect to FM wave of a frequency of 60 MHz and having a horizontal plane of polarization and expressed by the aforementioned dipole ratio to represent the directivity characteristic. The result of the directivity characteristic was such that the average of the gains in the seventy-two directions was −18.4 dB and the minimum gain was −23.6 dB. This embodiment thus can produce substantially the same effect to the previous embodiment of FIG. 10 and enables a keyless entry system or the like control system to perform a desired automatic control by receiving a radio frequency signal from any direction.

Figure 12:
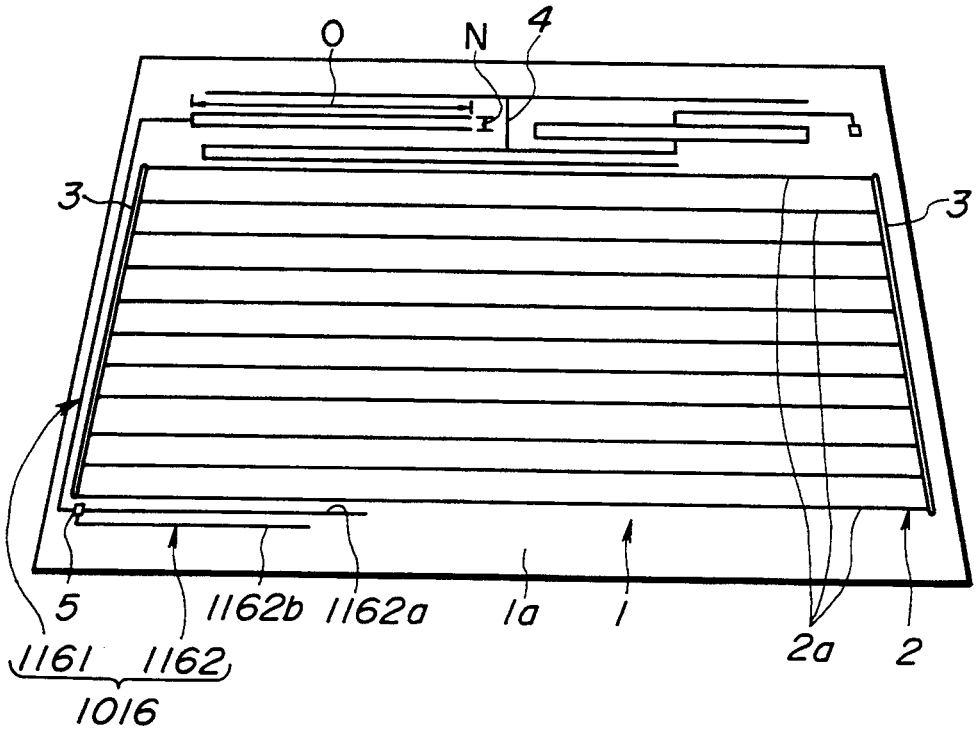

FIG. 12 shows a further embodiment in which the second antenna 1106 is disposed on the opposite side of the window glass as compared with the previous embodiments of FIGS. 1 to 11. The first element 1161 consists of a T-shaped portion which is not arranged in an area of the space 1*a* above the first antenna 4 but in an area of the space 1*a* defined by the first antenna 4, i.e., defined between the upper and lower ends of the first antenna 4. The first element 1161 is sized such that $O=420$ mm and $N=30$ mm. The second element 1162 consists of two horizontal conductive strips 1162*a*, 1162*b* of the different horizontal lengths. Except for the above, this embodiment is substantially similar to the previous embodiment of FIG. 10.

With such an automotive glass antenna of FIG. 12, the gains in various directions were measured with respect to FM wave of a frequency of 300 MHz and having a horizontal plane of polarization were measured, and it was found that this embodiment can produce substantially the same effect to the previous embodiment of FIG. 10.

While the present invention has been described and shown as above, various modifications and variations may be made thereto.

For example, the first antenna is not limited to what has been described and shown but may be of various different types.

Further, with regard to the first elements in the embodiments of FIGS. 1 to 3, the horizontal length D can be in the range of 300 mm to 1000 mm but preferably in the range of 400 mm to 800 mm. The distance L between the vertical conductive strip and the bus bar 2 should be larger than 2 mm and preferably larger than 5 mm. The distance M between the vertical conductive strip and the lateral edge of the window glass 1 should be larger than 10 mm and preferably larger than 15 mm so that adhesive or bond for attachment of the window glass can be applied to a marginal area between the vertical conductive strip and the lateral edge of the window glass 1.

Further, with regard to the T-shaped or inverted T-shaped first elements in the embodiments of FIGS. 4 to 6, the horizontal lengths $O_1$, $O_2$ can be in the range of 150 mm to 500 mm and preferably in the range of 200 mm to 400 mm. The vertical length N can be in the range of 5 mm to 30 mm and preferably in the range of 10 mm to 20 mm. The horizontal lengths $O_1$, $O_2$ are preferably equal to each other but the difference of about 100 mm therebetween causes scarcely any variation of the performance characteristic of the antenna. The interval L between the vertical conductive strip and the bus bar 2 should be equal to or larger than 2 mm and preferably equal to or larger than 5 mm. The interval M between the lateral edge of the window glass and the vertical strip should be equal to or larger than 10 mm and preferably equal to or larger than 15 mm.

With regard to the looped first elements in the embodiments of FIGS. 7 to 9, the horizontal length O can be in the range of 300 mm to 900 mm and preferably in the range of 400 mm to 750 mm. The vertical length N can be in the range of 5 mm to 30 mm and preferably within the range of 10 mm to 20 mm. The distance K between the vertical strip of the first element and the bus bar 2 should be equal to or larger than 2 mm and preferably equal to or larger than 5 mm. The distance M between the vertical strip of the first element and the lateral edge of the window glass should be equal to or larger than 10 mm and preferably equal to or larger than 15 mm so that adhesive or bond can be applied to the marginal area therebetween.

With regard to the T-shaped first elements in the embodiments of FIGS. 10 to 12, the horizontal length O ($O_1$, $O_2$) of the conductive strips forming a T-shaped can be in the range of 150 mm to 700 mm, whilst the vertical length N can be in the range of 5 mm to 30 mm and preferably 10 mm to 20 mm. The lengths $O_1$, $O_2$ are preferably equal to each other but the difference of around 100 mm therebetween causes scarcely any variation of the performance characteristic of the antenna. The distance L between the vertical strip of the first element and the bus bar should be equal to or larger than 2 mm and preferably equal to or larger than 5 mm.

The distance M between the vertical strip and the lateral edge of the window glass should be equal to or larger than 10 mm and preferably equal to or larger than 15 mm so that adhesive or bond can be applied to the marginal area therebetween.

With regard to the second elements in the embodiments of FIGS. 4 and 7, the horizontal lengths F, $F_1$, $F_2$ can be in the range of 150 mm to 1000 mm, whilst the vertical length $G_1$ can be in the range of 5 mm to 30 mm. The distance K between the second element and the heating strips is preferably in the range of 5 mm to 30 mm, so that the vertical length $G_2$ is determined so as to attain the preferable distance K.

With regard to the second elements in the embodiments of FIGS. 5, 8 and 10, the rectangular loops can be formed from the horizontal strips having the horizontal length of $0.02\lambda \cdot f^{\frac{1}{2}}$ $(1 \pm 0.2)$ where f is the frequency of radio wave to be received by the antenna and $\lambda$ is the wavelength of the radio wave, i.e., the horizontal length can be selected so as to be included within the range of $0.02\lambda \cdot f^{\frac{1}{2}}$ $(1 \pm 0.2)$. The rectangular loops may be changed in number by using two to four horizontal strips having the above described horizontal length. When the horizontal length is set to be in the range of 350 mm±70 mm, the antenna can function properly with respect to a radio frequency signal of a frequency around 300 MHz. On the other hand, when the horizontal length is set to be in the range of 840 mm±170 mm, the antenna can function properly with respect to a radio frequency signal of a frequency around 60 MHz.

With regard to the second elements in the embodiments of FIGS. 1, 6 and 9, the horizontal length E of the conductive strip extending between the feed point and the bent end is set so as to be within the range of 400 mm to 1200 mm and preferably 500 mm to 1000 mm. The horizontal length F of the conductive strip extending away from the bent end toward the feed point is determined on the basis of the kind of vehicle in such a way as to be equal to or larger than 200 mm but not exceed the horizontal length E.

With regard to the second element in the embodiment of FIG. 2, the horizontal length of the T-shape or inverted T-shaped portion can be in the range of 200 mm to 1000 mm and preferably in the range of 400 mm to 700 mm. The vertical length of the strip constituting the T-shaped or inverted T-shaped portion can be in the range of 5 mm to 50 mm.

With respect to the second element in the embodiment of FIGS. 3 and 11, the horizontal length of the horizontal conductive strips constituting T-shape can be in the range of 300 mm to 1000 mm. The vertical length of the vertical conductive strip constituting the T-shape can be in the range of 10 mm to 50 mm. The number of the horizontal strips can be in the range of two to four so as to constitute one or a plurality of -shaped portions.

The auxiliary elements having been described and shown are not always necessitated but various kinds of auxiliary elements such as a rectilinear, L-shaped, -shaped or T-shaped auxiliary element can be used with a view to improving the directivity characteristic and the reception gain.

While the glass antenna of this invention, when used in a keyless entry system for receiving a radio frequency signal of a frequency around 40 MHz, 60 MHz, 200 MHz or 300 MHz, is for exclusive use therefor, it can otherwise be used as a subsidiary antenna for Japanese FM radio broadcast wave of the frequency ranging from 76 MHz to 90 MHz, North American FM radio broadcast wave of the frequency ranging from 88 MHz to 108 MHz, Japanese TV broadcast wave of the frequency ranging from 90 MHz to 108 MHz, etc. In such a case, the more desirable result can be obtained when the antenna of this invention is used together with a main antenna constituted by a glass antenna provided to the upper portion of the glass plate above the defogging heater element, a glass antenna provided to the windshield, a glass antenna provided to the glass pane of the side window or a pole antenna to perform diversity reception.

Further, in the case the rear window glass is made up of a laminated glass, the glass antenna can be formed from thin metal wire such as copper wire which is embedded in an intermediate layer of polyvinyl butyral.

What is claimed is:

1. An antenna system attached to a vehicle rear window glass for receiving radio waves, the window glass being provided with a defogging heater element so as to leave a space around the heater element, the antenna system comprising:

a first antenna arranged in an area of said space above the defogging heater element and having a horizontal conductive strip and a vertical conductive strip; and a second antenna having a feed point arranged in a widthwise marginal area of said space under the heater element, and a pair of first and second elements connected to said feed point;

said first element having a vertical conductive strip arranged in an area of said space between the heater element and a lateral edge of the window glass, a T-shaped or inverted T-shaped conductive strip assembly made up of a longer horizontal strip portion and a shorter vertical strip portion and arranged in an area of said space above said first antenna and a horizontal conductive strip extending between said vertical strip portion of said T-shaped or inverted T-shaped conductive strip assembly and said vertical conductive strip and arranged in an area of said space above said first antenna;

said second element having at least a horizontal conductive strip arranged in an area of said space under the heater element.

2. An antenna system according to claim 1, wherein said second element further comprises a pair of second horizontal conductive strips, a first vertical conductive strip connecting one end of each of said second horizontal conductive strips, and a second vertical conductive strip extending upward from a portion of said second horizontal conductive strips, said first mentioned horizontal conductive strip extending between said second vertical conductive strip and said feed point.

3. An antenna system according to claim 1, wherein said horizontal conductive strip of said second element is connected to said feed point and extends horizontally away therefrom to have a bent end, said second element further having a horizontal conductive strip connected to said bent end of said first mentioned horizontal conductive strip of said second element and extending horizontally toward said feed point.

4. An antenna system attached to a vehicle rear window glass for receiving radio waves, the window glass being provided with a defogging heater element so as to leave a space around the heater element, the antenna system comprising:

a first antenna arranged in an area of said space above the defogging heater element and having a horizontal conductive strip and a vertical conductive strip; and a second antenna having a feed point arranged in a widthwise marginal area of said space under the heater element, and a pair of first and second elements connected to said feed point;

said first element having a vertical conductive strip arranged in an area of said space between the heater element and a lateral edge of the window glass, a looped conductive strip assembly made up of horizontal strip portions and vertical strip portions and arranged in an area of said space above said first antenna, and a horizontal conductive strip extending between one of said vertical portions of said looped conductive strip assembly and said vertical conductive strip and arranged in an area of said space above said first antenna;

said second element having at least a horizontal conductive strip arranged in an area of said space under the heater element.

5. An antenna system according to claim 4, wherein said second element further comprises a pair of second horizontal conductive strips, a first vertical conductive strip connecting one end of each of said second horizontal conductive strips, and a second vertical conductive strip extending upward from a portion of said second horizontal conductive strips, said first mentioned horizontal conductive strip extending between said second vertical conductive strip and said feed point.

6. An antenna system according to claim 4, wherein said horizontal conductive strip of said second element is connected to said feed point and extends horizontally away therefrom to have a bent end, said second element further having a horizontal conductive strip connected to said bent end of said first mentioned horizontal conductive strip of said second element and extending horizontally toward said feed point.

7. An antenna system attached to a vehicle rear window glass for receiving radio waves, the window glass being provided with a defogging heater element so as to leave a space around the heater element, the antenna system comprising:

a first antenna arranged in an area of said space above the defogging heater element and having a horizontal conductive strip and a vertical conductive strip; and a second antenna having a feed point arranged in a widthwise marginal area of said space under the heater element, and a pair of first and second elements connected to said feed point, respectively;

said first element having a first vertical conductive strip arranged in an area of said space between the heater element and a lateral edge of the window glass, a T-shaped conductive strip assembly having at least two horizontal strip portions and at least one vertical strip portion connecting one ends of said horizontal strip portions and arranged in an area of said space above said first antenna, and a horizontal conductive strip extending between said vertical strip portion of said T-shaped conductive strip assembly and said first vertical conductive strip and arranged in an area of said space above said first antenna;

said second element having at least a horizontal conductive strip arranged in an area of said space under the heater element.

8. An antenna system according to claim 7, wherein said second element further comprises two horizontal conductive strips which are connected at one end of each of horizontal conductive strips by a vertical conductive strip, said first mentioned conductive strip of said second element extending between said vertical conductive strip of said second element and said feed point.

* * * * *